United States Patent [19]

Nishikawa et al.

[11] 4,061,219

[45] Dec. 6, 1977

[54] PRINTING DEVICE

[75] Inventors: Tatsuo Nishikawa, Tachikawa; Toshiaki Ozawa, Tokyo, both of Japan

[73] Assignee: Canon Kabushiki Kaisha, Tokyo, Japan

[21] Appl. No.: 589,905

[22] Filed: June 24, 1975

Related U.S. Application Data

[63] Continuation of Ser. No. 333,551, Feb. 20, 1973, abandoned.

[30] Foreign Application Priority Data

| | | |
|---|---|---|
| Feb. 24, 1972 | Japan | 47-19114 |
| Mar. 2, 1972 | Japan | 47-21668 |
| Mar. 3, 1972 | Japan | 47-22099 |
| Mar. 8, 1972 | Japan | 47-23858 |
| Feb. 24, 1972 | Japan | 47-22771[U] |
| Feb. 24, 1972 | Japan | 47-22772[U] |
| Feb. 24, 1972 | Japan | 47-22773[U] |
| Mar. 2, 1972 | Japan | 47-26033[U] |

[51] Int. Cl.[2] ..... B41J 33/22

[52] U.S. Cl. ..... 197/164; 197/1 R; 197/151

[58] Field of Search ..... 197/1 R, 151, 153 R, 197/154, 160–165, 157, 158

[56] References Cited

U.S. PATENT DOCUMENTS

| | | | |
|---|---|---|---|
| 2,129,065 | 9/1938 | Loop | 197/1 R |
| 2,728,289 | 12/1955 | Johnson et al. | 197/1 R X |
| 2,785,627 | 3/1957 | Johnson | 197/1 R X |
| 2,800,386 | 7/1957 | Wockenfuss | 197/1 R X |
| 3,207,284 | 9/1965 | Pateman et al. | 197/151 |
| 3,302,562 | 2/1967 | Nelson | 197/1 R X |
| 3,532,204 | 10/1970 | Sasaki | 197/151 X |
| 3,670,981 | 6/1972 | Cavella | 197/164 X |
| 3,724,631 | 4/1973 | Kaczeus | 197/18 X |
| 3,726,381 | 4/1973 | Murphy | 197/151 X |
| 3,802,543 | 4/1974 | Howard | 197/1 R |
| 3,833,105 | 9/1974 | Howard | 197/1 R |

FOREIGN PATENT DOCUMENTS

| | | | |
|---|---|---|---|
| 2,057,961 | 6/1971 | Germany | 197/1 R |

*Primary Examiner*—Ralph T. Rader

*Attorney, Agent, or Firm*—Fitzpatrick, Cella, Harper & Scinto

[57] ABSTRACT

A printing device includes a wire printing head provided with a plurality of closely adjacent printing wires movable back and forth with respect to a web of printing paper with inking ribbon interposed therebetween. The device further includes a pair of spools for taking up the inking ribbon and a carriage for supporting thereon these spools and the printing head in an associated relationship. The carriage may be moved along a print line in a first direction by first drive means, and in a second direction opposite to the first direction by second drive means. Means is provided to rotatively drive said spools on the carriage in response to the movement of the carriage imparted by the first drive means. The shift of the carriage from the first direction to the second direction may be provided by an automatic reversing mechanism. The rotation of the spools on the carriage may be stopped by stop means when the carriage is being moved by the second drive means.

6 Claims, 47 Drawing Figures

(E)

PRINTING DEVICE

This is a continuation of application Ser. No. 333,551, filed Feb. 20, 1973, now abandoned.

BACKGROUND OF THE INVENTION

1. Field of the Invention

This invention generally relates to improvements in a high-speed printing device for data processing apparatus, and praticulary to a printer suitable for use with compact instruments. More specifically, the invention relates to a simply constructed printing device in which a carriage provided with a printing head supports thereon a pair of spools for inking ribbon and the movement of the carriage is utilized as a drive source for moving the inking ribbon.

The present invention also relates to a wire printing head for use with the described printer device which employs printing wires adapted to print dots on printing paper to form alphanumeric characters or other symbols, thereby accomplishing very small prints at high speeds.

2. Description of the Prior Art

Printing devices of the described type are well-known in the art and the technology pertaining thereto has been disclosed in U.S. Pat. No. 2,129,065; 2,632,386; 2,674,652; 2,720,164; 2,773,443; 2,869,455; 3,236,351; 3,318,429; 3,322,253; 2,879,876; etc.

SUMMARY OF THE INVENTION

It is an object of the present invention to improve those conventional printing devices and to make the printers more compact by exquisitely arranging a fan-shaped wire printing head and a pair of circular spools for inking ribbon on a reciprocally movable carriage.

It is another object of the present invention to simplify the inking ribbon transport mechanism by operatively associating the carriage with the spools to utilize the movement of the former as the drive source for the inking ribbon on the latter.

It is still another object of the present invention to provide high-speed printing by making such an arrangement that the drive to a carriage transport screw shaft is disconnected in accordance with a signal representing the completion of the printing stroke of the carriage or a print stop signal produced midway of one-line printing, whereupon the carriage is immediately returned to its start position.

BRIEF DESCRIPTION OF THE DRAWINGS

Other objects and features of the present invention will become fully apparent from the following detailed description taken in conjunction with the accompanying drawings, in which.

DESCRIPTION OF THE PREFERRED EMBODIMENTS

Figure 2:
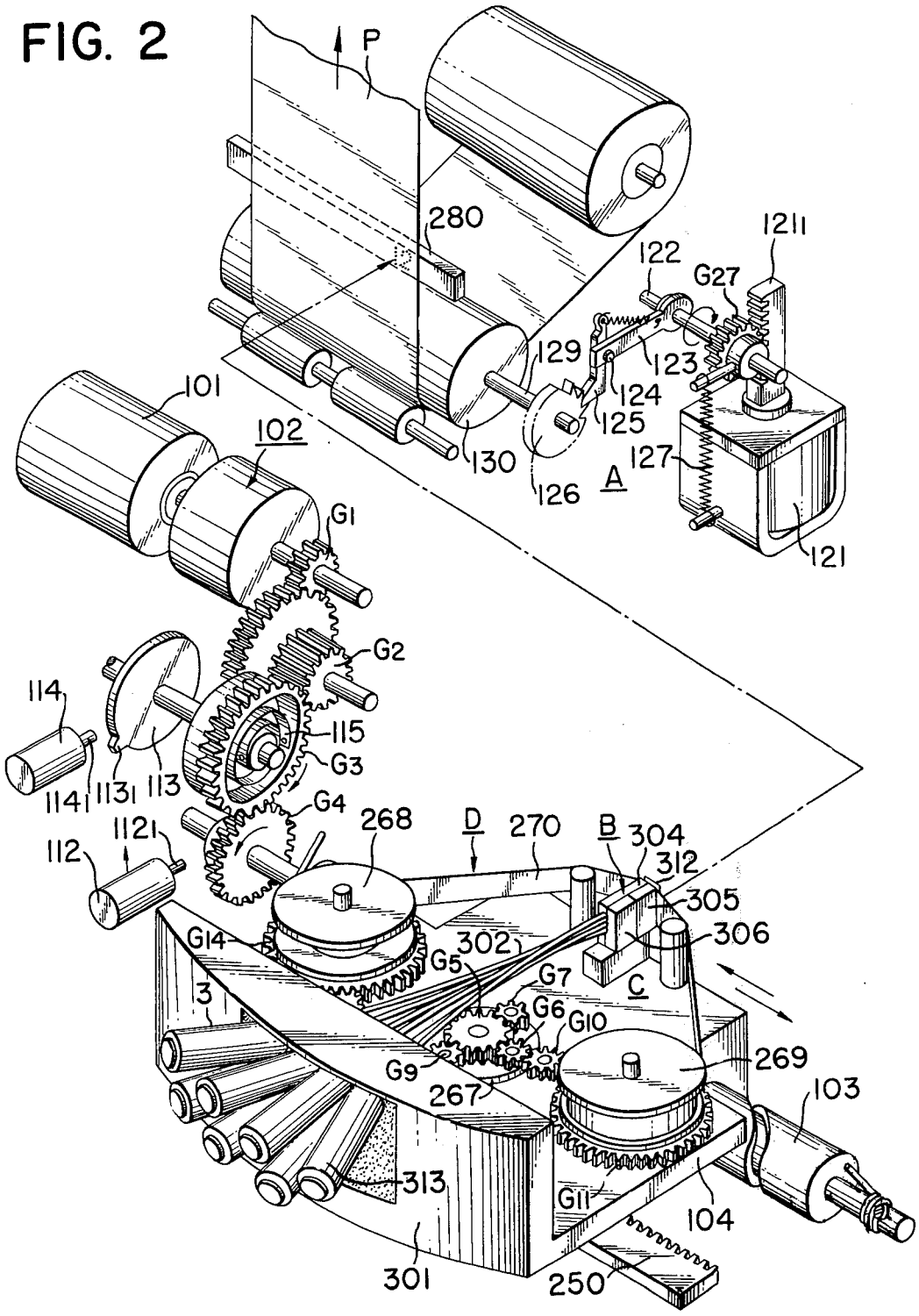
FIG. 2 is a perspective view showing the arrangement of various parts of the printer device according to the present invention.

Description will first be made of the various units forming the printer device of the present invention as shown in FIG. 2.

Paper Feeder A

In response to a print stop signal, a paper feed signal is applied from a printer control to a solenoid 121 to attract a plunger downwardly and lower a rack $\mathbf{121_1}$ integral therewith. This causes a gear G27 and its shaft 122 to be rotated clockwise to thereby pivot a lever 123 secured to the shaft 122, so that a feed pawl 125 attached to the lever 123 by means of a pin 124 is raised to cut off a current supply to the solenoid 121, whereupon those elements $\mathbf{121_1}$–125 are returned to their original positions by the action of a spring 127. At the same time, the feed pawl 125 rotates a ratchet wheel 126, which in turn advances a web of paper P by a preset distance corresponding to one print line.

Printing Head B

This comprises a printing head holder 301 on the base plate 104 of a carriage C, printing solenoids 313 secured to the holder 301, printing wires 208 (FIG. 7) movable back and forth by the solenoids 313, guide tubes 302 for smoothly guiding the printing wires, and printing wire guide plates 304 and 305 and guide tube fixing plate 306 for holding the front ends of the guide tubes 302 in vertical alignment. When a print signal current flows to all or selected ones of seven printing solenoids 313, the associated printing wires are extending from the printing side of the guide plate 304 toward a printing plate 280 to print dots on the paper P with ink supplied from inking ribbon 270. Where there are seven of such printing wires aligned in a vertical line, there will be printed on one line thirty symbols such as alphanumeric characters or other indicia by selecting $7 \times 5$ dots provided by the vertically aligned seven wires when the carriage is moved laterally by five columns. An anti-contamination plate 312 perforated for passing the wires therethrough is provided between the inking ribbon 270 and the web of paper P so that the paper may not directly be contacted by any other portion of the inking ribbon than those localized portions which are pushed by the printing wires.

Carriage C

The base plate 104 is engaged with the spiral groove of a transport screw shaft 103 therebelow by means of internal thread or roller pin or the like. A motor 101 drives to rotate the screw shaft 103 to move the base plate 104 from right to left, in case of the illustrated embodiment, during which printing is carried out. When the carriage base plate 104 reaches the end position of its leftward stroke, a spiral return spring 115 reverses the rotation of the screw shaft 103 to return the base plate to its start position. During the described leftward stroke, printing takes place from the lowest (rightmost) column to the successive columns until there is no pattern to be printed on one line, whereupon the original position of the carriage is immediately restored. This is effective to realize high-speed printing. If the thread on the screw shaft 103 is formed in the opposite direction, it will readily be possible to provide the printing stroke of the carriage in the opposite direction.

When the carriage driving motor 101 is a normally rotated AC motor, a print command signal may be supplied to an electromagnetic clutch 102. Where the motor 101 is a DC motor, such signal may be supplied to the motor 101 and to the clutch 102, simultaneously Thereby, the screw shaft 103 is rotated counter-clockwise through the aid of a gear train G1–G4, thus moving the base plate 104 from right to left. The length of such leftward stroke is equal to or slightly smaller than the width of the paper web P. During the stroke, the spiral return spring 115 provided in the inner hollow of gear G3 is charged. A clock disc 113 is mounted on the shaft of any one of the gears G1–G4 and has a lug $\mathbf{113_1}$. As the lug $\mathbf{113_1}$ approaches an iron core $\mathbf{114_1}$ in a signal detector 114, a signal is produced in the detector through electromagnetic induction to disconnect the electromagnetic clutch 102, whereupon the transport screw shaft 103 is rotated by the spiral spring 115 in the direction opposite to that described above, thus moving back the base plate 104 from left to right. A return stroke stop signal is also provided by the said signal detector 114.

Another signal detector 112 is provided adjacent the gear G4. This signal detector functions on the same principle as that of the aforesaid detector 114 to produce a signal corresponding to each tooth of the gear G4 with the aid of the relationship between the top and root of each tooth. Such signal is used as a signal for one lateral dot of the vertically aligned printing wires, thus being useful to form a symbol or character.

Taking into account any possible delay in the rising time of the motor 101 and electromagnetic clutch 102 at the beginning of the movement of the above-described electrically driven base plate 104 and any possible inertia shock occurring at the ends of the reciprocal strocks, it is possible to design the printing head such that it is moved at a uniform velocity throughout a printing cycle, as will be described further.

Inking Ribbon Transport Mechanism D

A length of inking ribbon 270 has its opposite ends secured to spools 268 and 269 rotatably supported on the carriage base plate 104, and extends to pass around the front of the printing wire plates 304 and 305 of the printing head. The inking ribbon is supplied only during the leftward or printing stroke of the carriage and not during the backward stroke thereof. When all the ribbon has been taken up on one of the spools 269 (or 268), the spools automatically reverse their rotations so that one of them 268 (or 269) may take up the ribbon.

A specific example of the ribbon transport mechanism is illustrated in FIGS. 3 to 11. A rack 250 (FIGS. 7 and 8) is provided on an unshown printer body and extends parallel to the transport screw shaft 103. A gear 251 is provided below the base plate 104 and meshes with the rack 250 to transmit the drive to a driven wheel 252 via a one-way transmission gearing 253–254 which performs one-way transmission only during the printing stroke of the printing head. The driven wheel 252 is mounted on a shaft $\mathbf{252_2}$, which extends through a housing 265 fitted to the base plate 104 and is integrally connected to a gear G5 on the base plate 104. The gear G5 may be in mesh engagement with gears G6–G9 rotatably supported on a turret plate 267 at quadrant positions therein, the turret plate overlying the housing 265. Spools 268 and 269 are fitted on the shafts of discs $271_1$ and $271_2$, respectively, with their projections $268_1$ and $269_1$ being engaged in holes $271_3$ of the discs. Gears G14 and G11 are formed integrally with these discs and mesh with relay gears G12, G13 and G10 mounted on the base plate 104. It is now assumed that the gears G9 and G12 are in engagement with each other.

Figure 1:
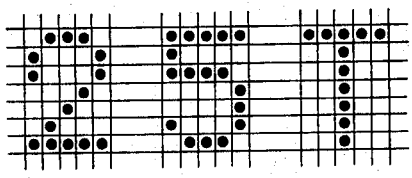
FIG. 1 shows some examples of the matrix dot patterns formed by the printer of the present invention.
Figure 3:
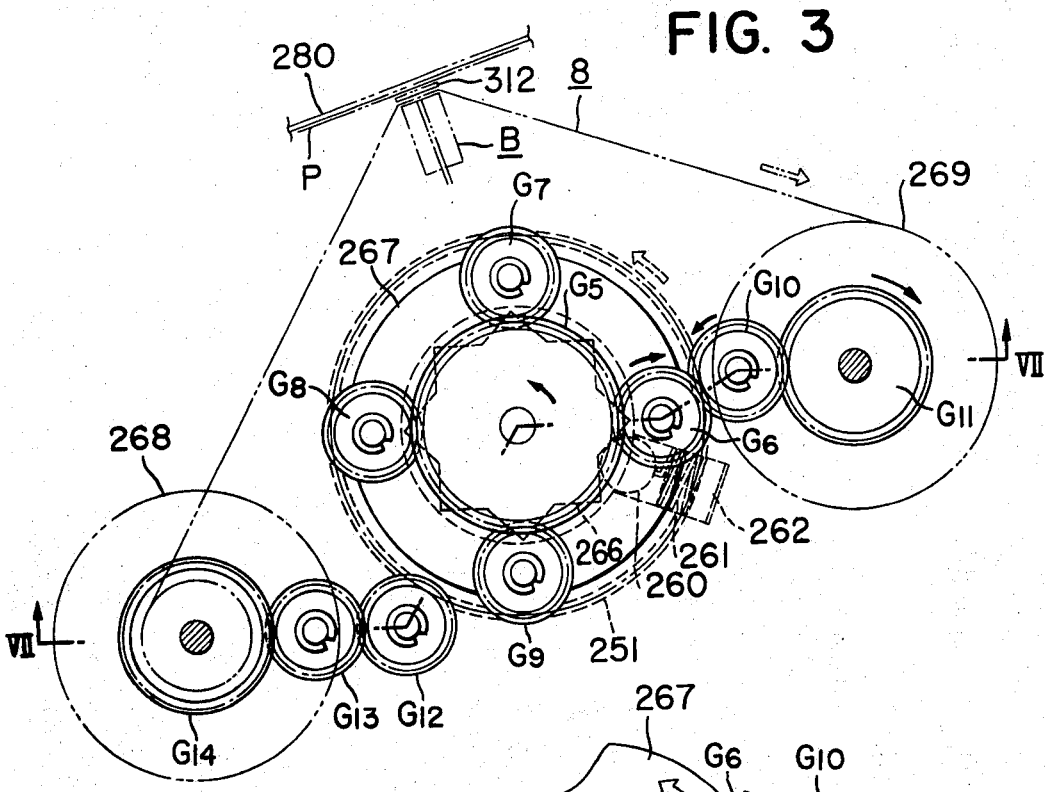
FIG. 3 is a plan view of the inking ribbon transport mechanism.

As carriage base plate 104 is moved from right to left for its printing stroke, the gear 251 is moved along the rack 250 while rotating the driven wheel 252 and gear G5 counter-clockwise as seen in FIG. 3, so that the rotation of the gear G5 is transmitted to the gears G6–G9 which in turn rotate the turret plate 267 in the same direction to thereby bring the gear G6 into mesh engagement with the relay gear G10 to stop the turret 267, and on the other hand, the transmission to the relay gear G12 is cut off. As a result, the inking ribbon 270 is taken up on the spool 269.

Figure 4:
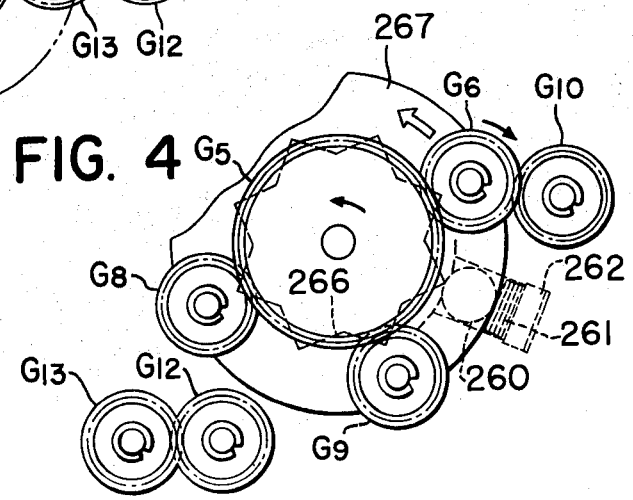
FIGS. 4, 5 and 6 are plan views for illustrating the shift of mesh engagement between various gears during the change of the ribbon transporting direction.
Figure 5:
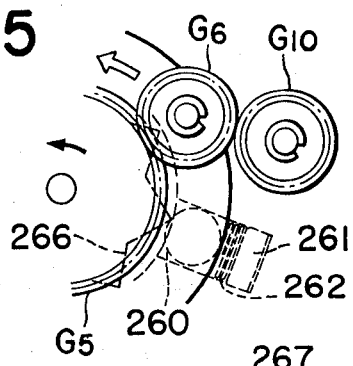
Figure 6:
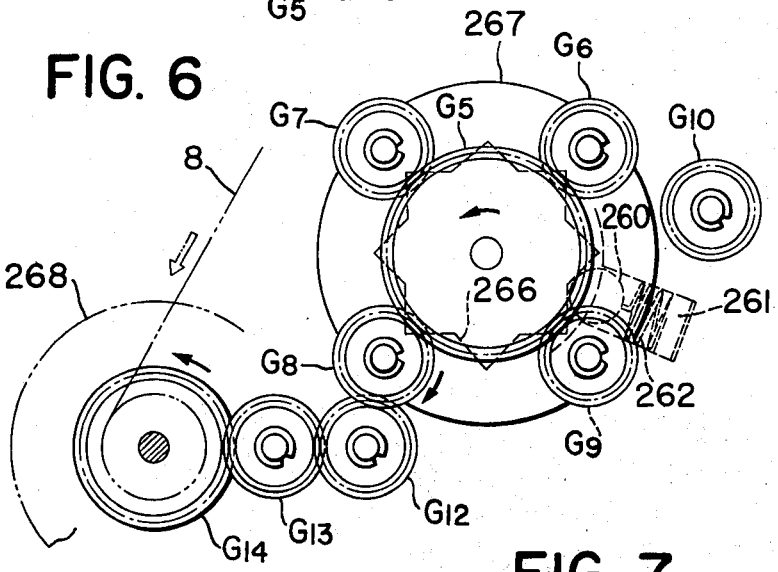

When the amount of the inking ribbon on the spool 268 becomes null, the other spool 269 is no longer rotatable because the shaft thereof has one end of the ribbon secured thereto. As a result, the gear G6 rotates along the gear G10, accompanied by the rotation of the turret plate 267, in the manner as shown in FIGS. 4 and 5. In the shown case, the gear rotates 45° due to a click mechanism comprising an index 226 intetral with the turret plate, a ball 260, a spring 261 and a push screw 262, until the gear G6 is disengaged from the gear G10 with the gear G8 coming into engagement with the gear G12, in the manner as shown in FIG. 6. Thus, the inking ribbon 270 is taken up by the spool 268. When the inking ribbon on the spool 269 comes to a zero amount, the turret plate 267 now begins to rotate counter-clockwise because the shaft of the spool 269 has the other end of the ribbon secured thereto. Thus, the take-up direction of the inking ribbon is reversed to that shown in FIG. 3 due to the action described just above.

Figure 10:
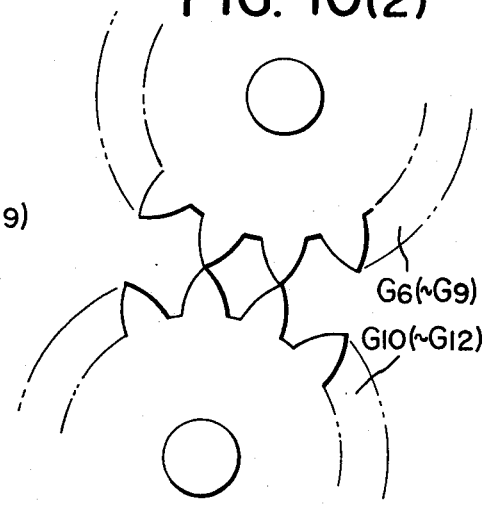
FIG. 10(1) to (3) show some forms of the teeth for the reversing gears.
Figure 10:
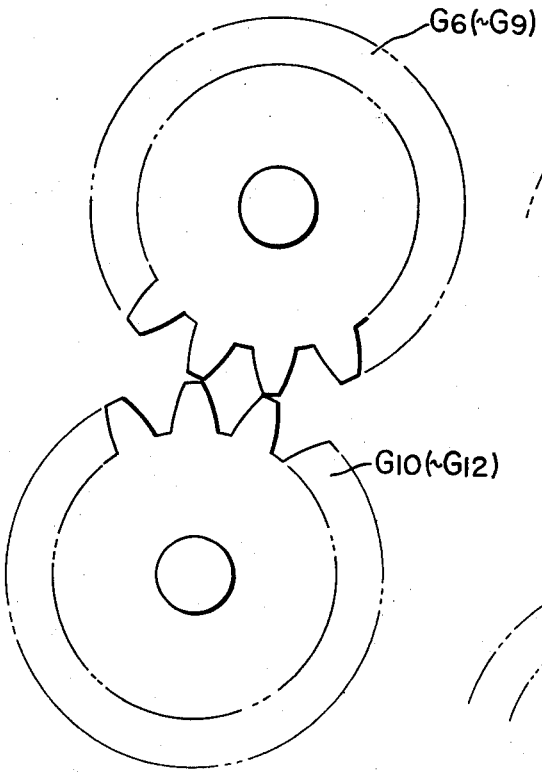
Figure 10:
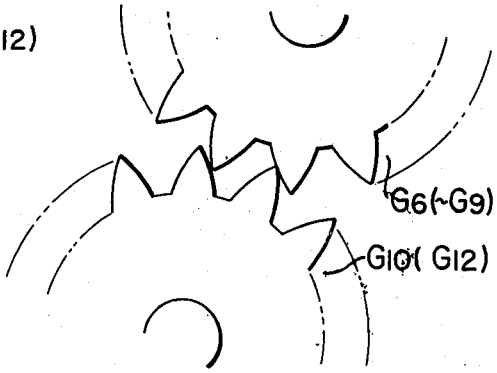

To avoid the likelihood that the mesh engagement between the gear G6–G9 and the gear G10 or G12 may fail to occur with the tooth end thereof abutting each other in the manner as shown in FIG. 10(1), these gears should preferably be formed with pointed teeth of special configuration as shown in FIGS. 10(2) and (3).

Figure 11:
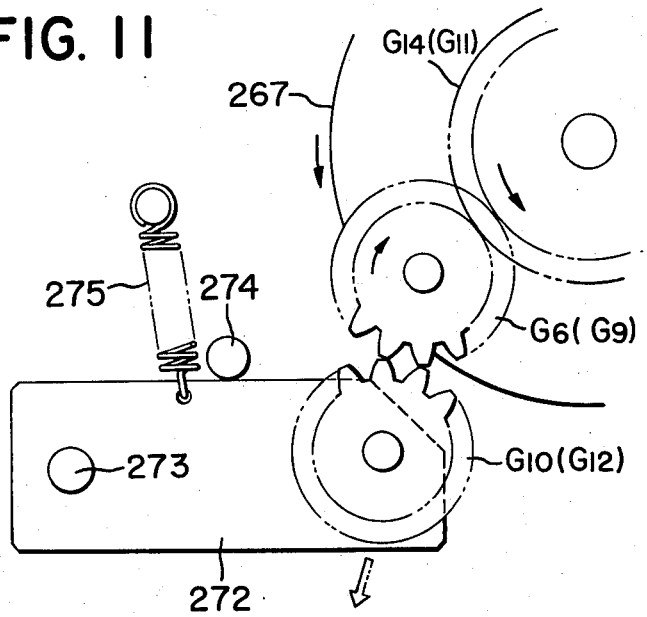
FIG. 11 is a front elevation of the mechanism for ensuring accurate meshing between the gears.
Figure 13:
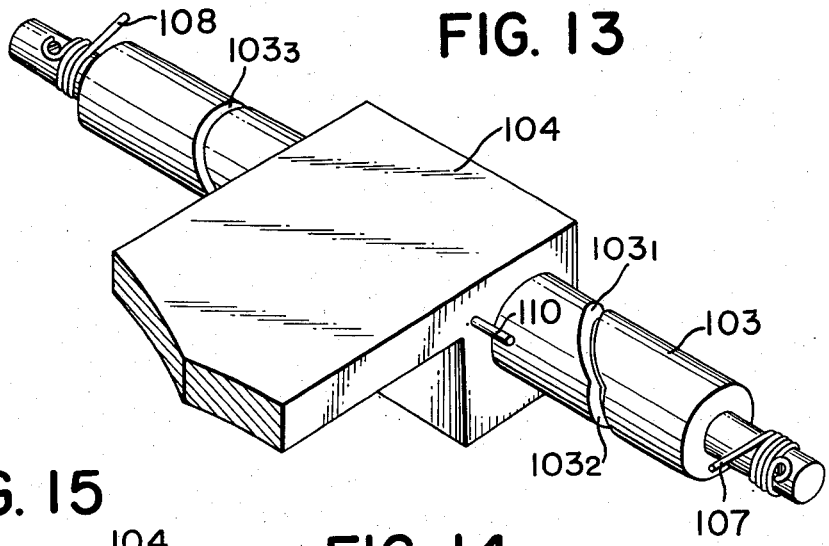
FIG. 13 schematically shows the mechanism for reciprocating the carriage.
Figure 15:
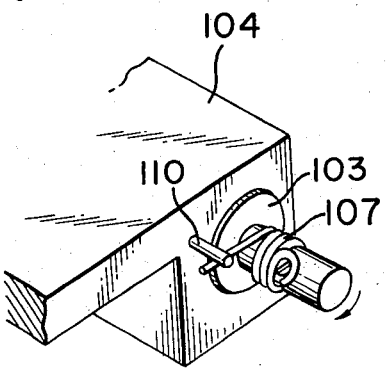
FIGS. 14 and 15 are perspective views showing the operation of shock absorbing means provided at the opposite ends of the carriage and on a carriage transport screw shaft.

Also, as shown in FIG. 11, the gear G10 and G12 may be mounted on a lever 272 which is pivotable about a shaft 273 so as to be retractable by the force of a spring 275 to ensure the mesh engagement of these gears with the gears G6–G9 when they meet together.

To reverse the take-up direction of the inking ribbon from that of FIG. 3 to that of FIG. 6 or vice versa, the driven wheel 252 and the gear 251 are angularly rotated about 90° and about a quarter of one full rotation, respectively. However, the carriage C will revert to its rightmost start position from an intermediate position which is short of the extremity of the printing stroke if there is no print signal representing that column corresponding to such intermediate position, and thus the carriage may return to its start position before the direction of movement of the inking ribbon has been reversed. The gear 251 is thus not always ensured to make a quarter of one full rotation during such reversion of the carriage. In cases where the angular rotation of the gear 251 is less than a quarter of one full rotation, the ball 260 of the click mechanism may fail to reach the apex of the index 266 and be pulled back by the force of spring 261 during the return stroke of the carriage to prevent the inking ribbon from reversing its direction of movement.

Figure 7:
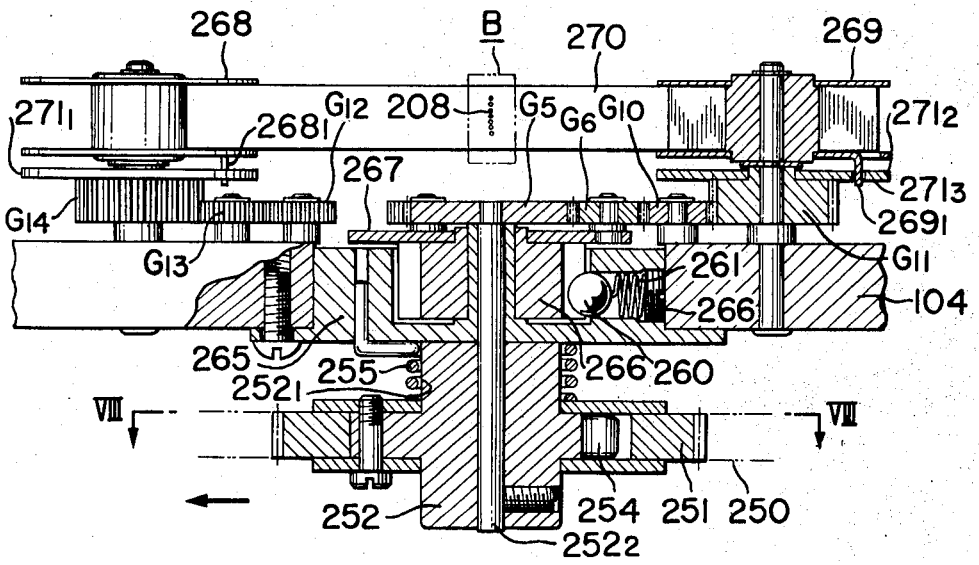
FIG. 7 is a cross-sectional elevation taken along line VII—VII in FIG. 3.
Figure 8:
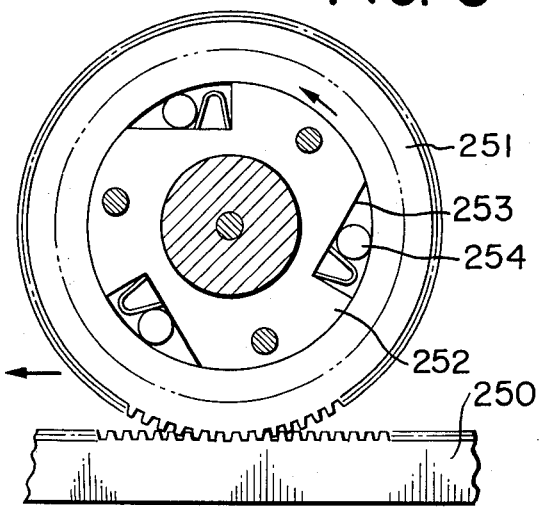
FIG. 8 is a cross-sectional plan view taken along line VIII—VIII in FIG. 7.
Figure 9:
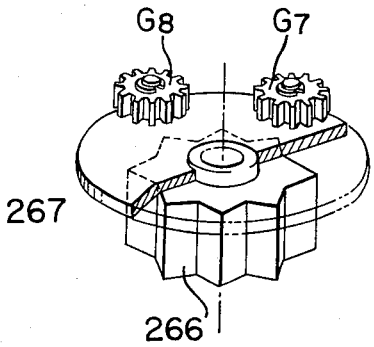
FIG. 9 is a perspective view of the turret plate and index wheel shown in FIG. 7.

To avoid this, as shown in FIG. 7, a charged spring clutch 255 is wound around the boss $252_1$ of the driven wheel 252 and has one end thereof secured to the housing 265 so that the driven wheel 252 (or the gear G5) is freely rotatable in the direction of the drive from the gear 251 (i.e. in the counter-clockwise direction) upon relaxation of the spring 255 but that the spring 255 is charged during the reverse rotation to prevent the ball 260 from being pulled back by the force of the click spring 261, thus permitting the driven wheel 252 to store its rotational energy sufficiently to accomplish the reversion of the inking ribbon.

Figure 12:
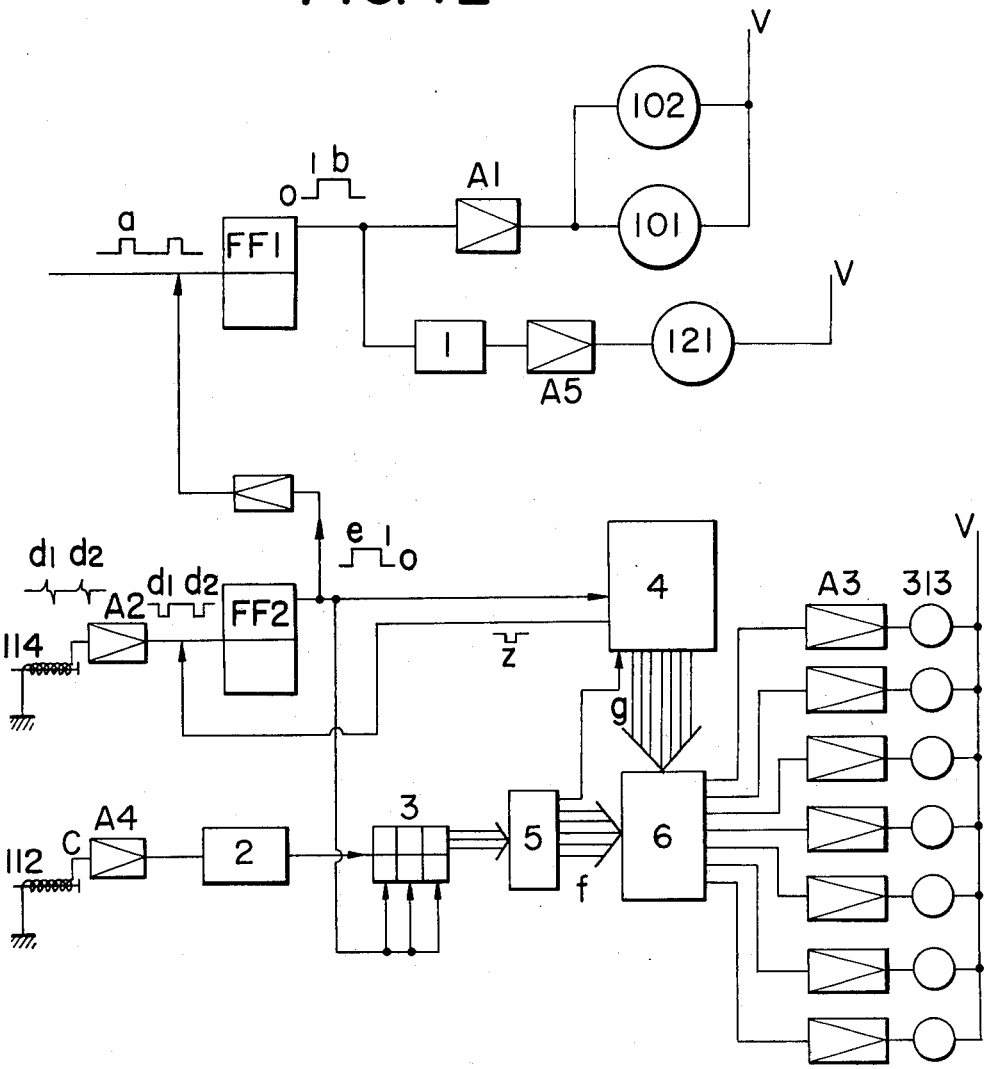
FIG. 12 is a block diagram of the circuit for drivingly controlling the printing wires.

FIG. 12 shows, in block diagram, a combination of the wire matrix printer of the present invention and a computer. A print command signal *a* entered manually or by a computer 4 reaches a flip-flop circuit FF1, whose output *b* is thus changed from 0 to 1 and applied as input to an amplifier A1, which in turn energizes the carriage driving motor 101 and the electromagnetic clutch 102 to start the carriage C from right to left.

Soon after that, a signal *c* from the signal detector 112 is amplified by an amplifier A4 and passed through a waveform shaping circuit 2 to a counter 3, but this counter still remains inoperative. When the transport screw shaft 103 rotates through an angle, say, 60° (which corresponds to the lapse of the rising time of the motor and clutch 101 and 102), signals $d_1$ and $d_2$ from the signal detector 114 are passed through an amplifier A2 and into a flip-flop circuit FF2, whose output *e* is thus changed from 0 to 1 and applied to the computer 4 as a print start command signal therefor. The signal from the flip-clop FF2 also enters the counter 3 to unlock the same, while the aforesaid signal from the signal detector 112 enters a decoder 5, in which this signal is decoded and applied as input to a character generator 6. The decoder also applies a signal to the computer 4 each time one character or symbol has been printed, and when the print register content in the computer is less than the time between $d_1$ and $d_2$, the computer sends to the flip-flop circuit FF2 a print stop signal *z* representing the absence of the print register content, whereafter the output of FF2 enters the flip-flop FF1 to deenergize the motor and clutch 101 and 102. Thus, the carriage base plate 104 is returned from any current position in one print line to its start position by the action of the spiral spring 115.

On the other hand, dot shift signals *f* from the decoder 5 and information signals *g* from the computer 4 are applied to the character generator 6, whereupon signals selected therein are applied through an amplifier A3 to solenoids 313 to thereby extend the printing wires in accordance with the sequence of a print character formation, thus forming a character.

When the transport screw shaft 103 has made two full rotations, for example, to move the carriage base plate 104 by a predetermined length of stroke, the stop signal $d_2$ from the signal detector 114 enters the flip-flop FF2, whose output *e* is thus changed from 1 to 0 and applied to FF1 which in turn deenergizes the motor 101 and clutch 102 to return the carriage to its start position.

The rising signal during such change of the output *e* from 1 to 0 is utilized to cause the waveform shaping circuit 1 to produce a pulse signal so that a paper feed signal may be delivered through an amplifier A5 to a paper feed solenoid 121 to feed the paper.

FIGS. 13 to 16 illustrate a mechanism for stopping the carriage 104 at the ends of its stroke in a shock-absorbing manner. The carriage 104 is provided with a roller 106 corresponding to a nut for meshing with a spiral groove $103_1$ formed on the transport screw shaft 103, so that the carriage may be reciprocated with the rotation of the screw shaft 103. Stop members are provided to ensure a predetermined length of reciprocal stroke for the carriage 104. More specifically, stop pins 109 and 110 are provided in the opposite end faces of the carriage 104, and spring stops 107 and 108 are wound in opposite directions on the opposite end portions of the transport screw shaft 103, one end of each spring stop being secured to the shaft.

Figure 14:
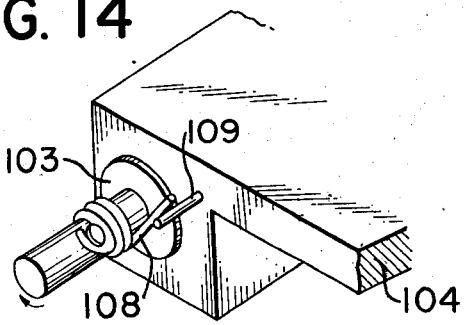

With such construction, the carriage 104 will be moved leftwardly for its forward stroke if the screw shaft 103 is rotated counterclockwise as viewed in the drawing. Even if the drive from the drive system is cut off upon or just before arrival of the carriage at the extremity of its forward stroke, the transport screw shaft 103 will continue to rotate slightly further due to inertia. At that time, the spring stop 108 will strike against the stop 109 and roll thereon, as shown in FIG. 14, thereby developing a great resistance sufficient to absorb the inertial rotation of the screw shaft and stop it immediately.

It will thus be seen that the described construction is useful to prevent any overrunning of the moving body (carriage) and moreover, the combination of a rigid stop member and a spring stop member can act in a shock-absorbing manner and reduce the shock noise which would be greater in the combination of two rigid stop members. In addition, the charge of the stop 108 is useful to assist the carriage in reverting to its return stroke and accordingly shorten the rising time of the drive system. It will be noted that a spiral spring 115, which acts to cut off the drive during the return stroke and is charged during the forward stroke, is provided to reverse the direction of the stroke of the carriage.

Figure 16:
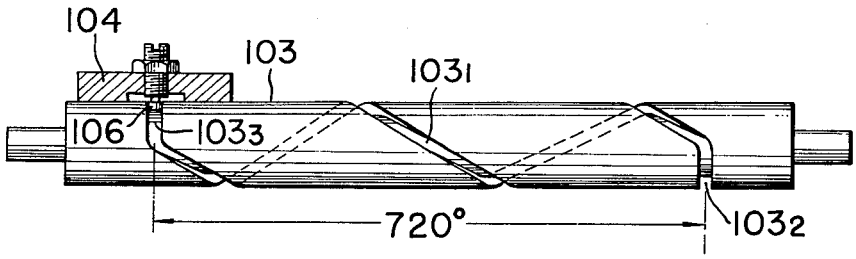
FIG. 16 is a front elevation of the transport screw shaft.

In the above-described construction, the carriage is not free of some moment of inertia. To eliminate it, inertial transport absorbing grooves $103_2$ and $103_3$ are formed in continuation of the opposite ends of the spiral groove $103_1$ and in the direction perpendicular to the axis of the transport screw shaft, as shown in FIG. 16. These grooves $103_2$ and $103_3$ each extend over a length corresponding to a half rotation of the screw shaft. The spiral groove $103_1$, which substantially acts as the transport groove, extends between the opposite grooves $103_2$ and $103_3$ (and over a length corresponding to two full rotations of the shaft in the shown case).

Figure 17:
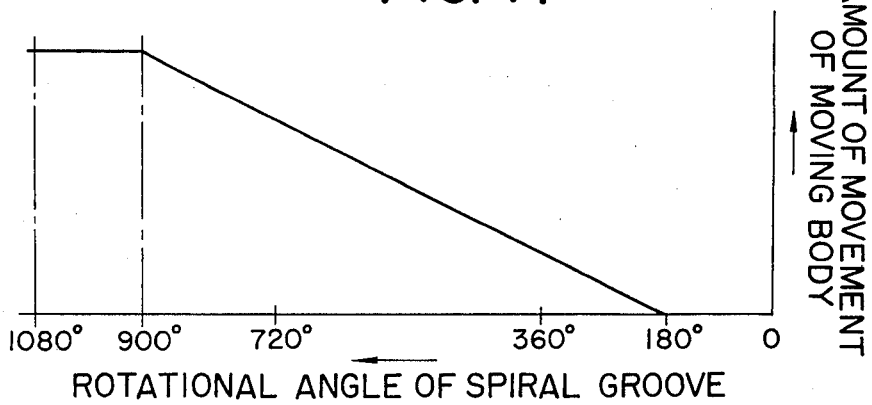
FIG. 17 is a graph illustrating the relationship between the angular rotation of the transport screw shaft and the movement of the moving body or carriage.

Further, by making such a design that the drive is cut off when the carriage 104 moving from right to left reaches the left end of the spiral groove $103_1$ and that the carriage roller pin 106 engaged in the spiral groove $103_1$ is then positioned in the perpendicular groove $103_3$, any overrunning of the carriage 104 resulting from the inertial rotation of the screw shaft 103 may be eliminated (see FIG. 17, 900°–1080°, 0°–180°), so that the shock-absorbing spring stop 108 acts to stop the carriage while the roller pin $103_3$ is moving along the groove $103_3$.

Thus, two full rotations of the transport screw shafts 103 provides a predetermined length of stroke properly. Since the carriage 104 provides no load to the rotation of the transport screw shaft 103 as long as the roller pin moves along the perpendicular groove $103_3$ (or $103_2$), the inertial load imparted to the drive motor or the electromagnetic clutch is reduced, thus permitting a reduced size and reduced rising time of the motor and clutch. This is also useful to reduce the size of the spring stops 107 and 108.

Since the above-described stop mechanism works for each stroke of the carriage 104, the spring stops 107 and 108 are especially quick to be fatigued and ready to cause failures. Moreover, the stop pins 109 and 110 may be subject to breakage.

Figure 18:
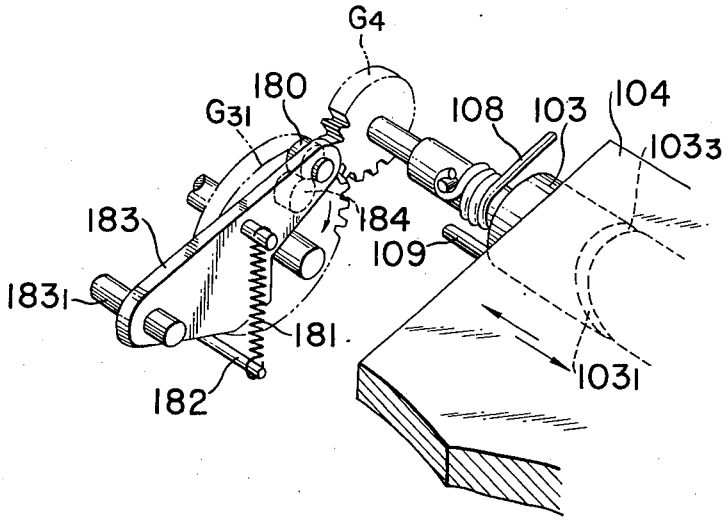
FIG. 18 is a perspective view of means for stopping the carriage at the end of its stroke.
Figure 19:
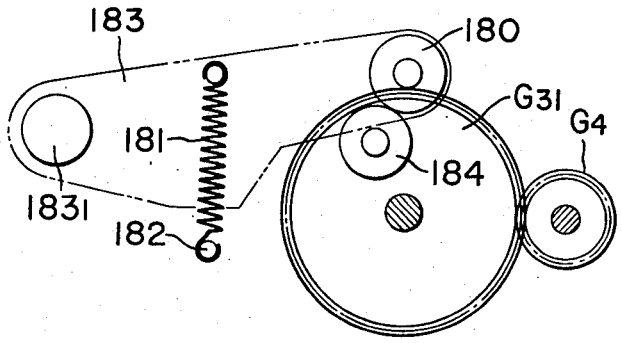
FIG. 19 is a front elevation showing the essential parts of such stop means.
Figure 20:
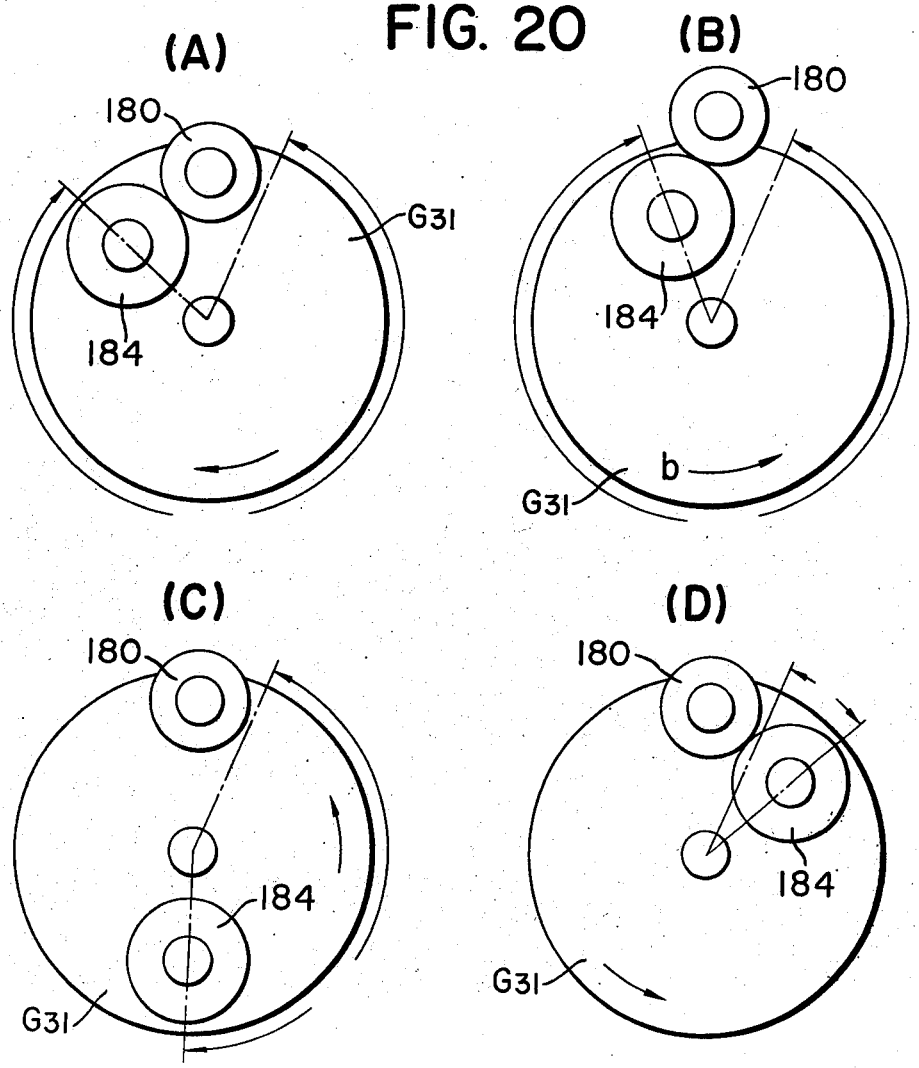
FIG. 20 illustrates a sequence of damping and stopping action.
Figure 20:
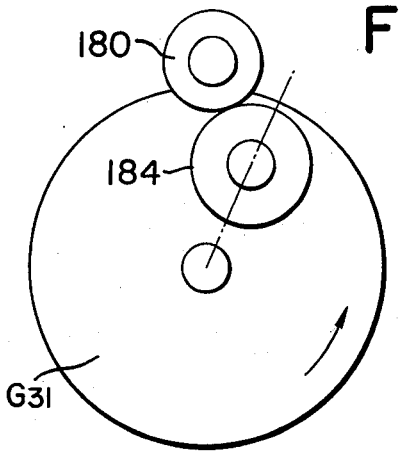

Therefore, damper means may be additionally provided which is adapted to act immediately before the described stop mechanism operates, as is shown in FIGS. 18 to 20. Such damper means may be provided by a gear or other rotary member G31 meshing with the gear G4 or other suitable gear in the driving system, and a cam 184 attached to the gear G31, the cam 184 preferably being in the form of a roller pin. A lever 183 having a roller pin 180 corresponding to the roller pin 184 is pivotally mounted on a shaft $183_1$and normally biased into engagement with a stop 182 by a damper spring 181.

The gear ratio of the gears G4 and G31 is selected such that when the carriage 104 has come to a position just short of its leftmost end position and is about to overrun due to the inertial rotation of the transport screw shaft 103 and drive system with the drive cut off, the roller pin 184 on the gear G31 is engaged with the roller pin 180 in the manner as shown in FIG. 20(A), to thereby actuate the roller pin 180 and lever 183 against the force of the spring 181 and cause the reaction thereof to act as a damping force which stops the roller pins in the position as shown in FIG. 20(B). Further, by making such a design that the stop 108 begins to act on the stop 110 at an intermediate position between the positions of FIGS. 20(A) and (B), the stop means 108, 110 may be sufficiently protected and produce reduced noises and the spring force required may be smaller than that individually required for each of these stop means.

When the transport screw shaft 103 reverses its rotation to move the carriage from such stop position back to its rightward stroke, the rotary member G31 is rotated in the direction of arrow *b* shown in FIG. 20(B). Thus, the spring 181 expedites the rotation of the rotary member G31 and cooperates with the spring stop 108 to help the transport screw shaft 103 rotate clockwise, thus reducing the rising time of the electromagnetic brake in the motor or the drive system and accordingly serving to reduce their sizes. When the transport screw shaft shifts from its transient rising condition into its normal uniform rotation, the roller pins 180 and 184 are disengaged from each other and thus, impart no adverse effect to the uniform movement of the carriage 104.

FIGS. 20(C) to (E) illustrate the sequence in which the carriage 104 is moved rightwardly until subjected to a damping action.

Next, the printing head provided on the carriage will particularly be described with respect to the printing wire means used with the printer of the present invention.

The printing wire means of this type, which comprises elongated printing wires adapted to be extended and retracted by electromagnetic solenoids of weak capacity, must satisfy the following strict conditions:

1. the printing wires be very light in weight but provide a strong impression force;
2. the printing wires be free of deflection, bending or breakage during printing; and
3. the printing wires be durable and capable of holding proper dot positions without any tear and wear being produced in the wires and in the guide openings therefor.

An embodiment of the printing wire means designed from such viewpoints is shown in FIGS. 21 to 29.

Figure 21:
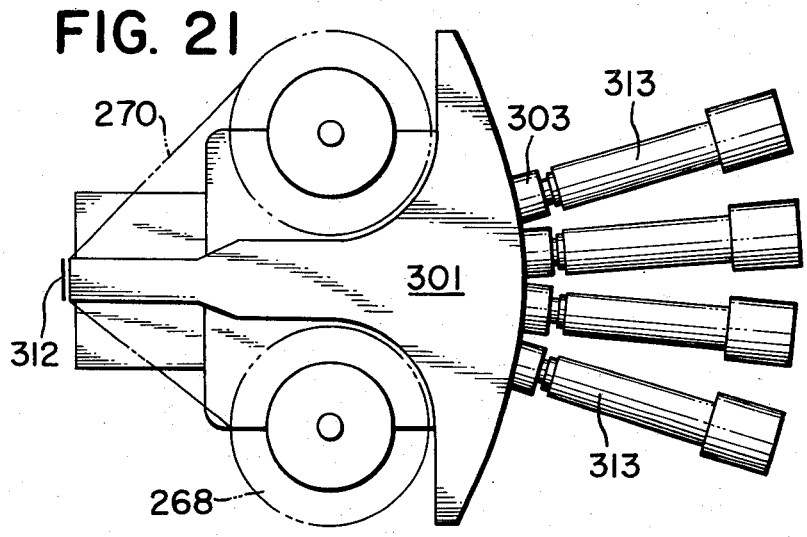
FIG. 21 is a plan view showing a form of the printing head in the matrix wire printer.
Figure 22:
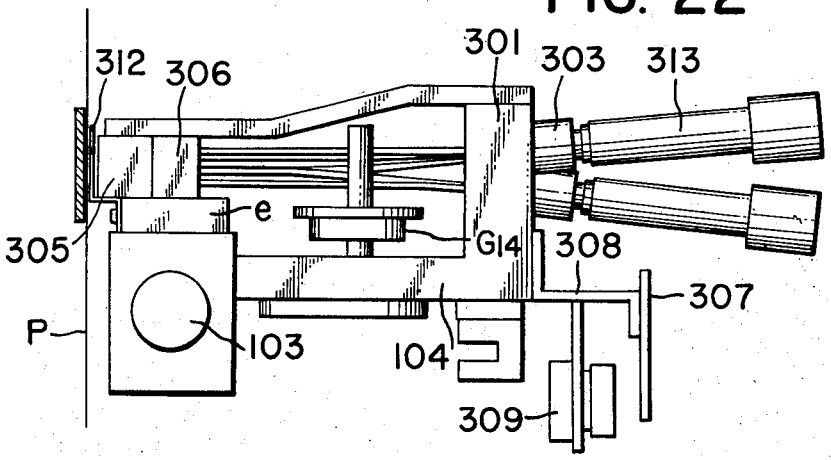
FIG. 22 is a side elevation of such printing head.
Figure 23:
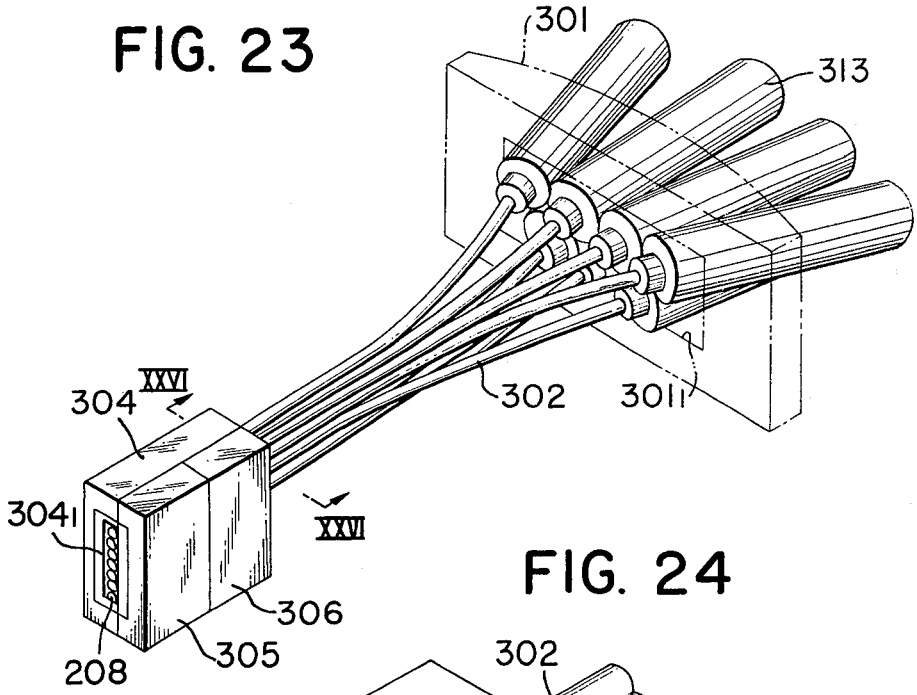
FIG. 23 is a perspective view showing a part forming the printing head.
Figure 24:
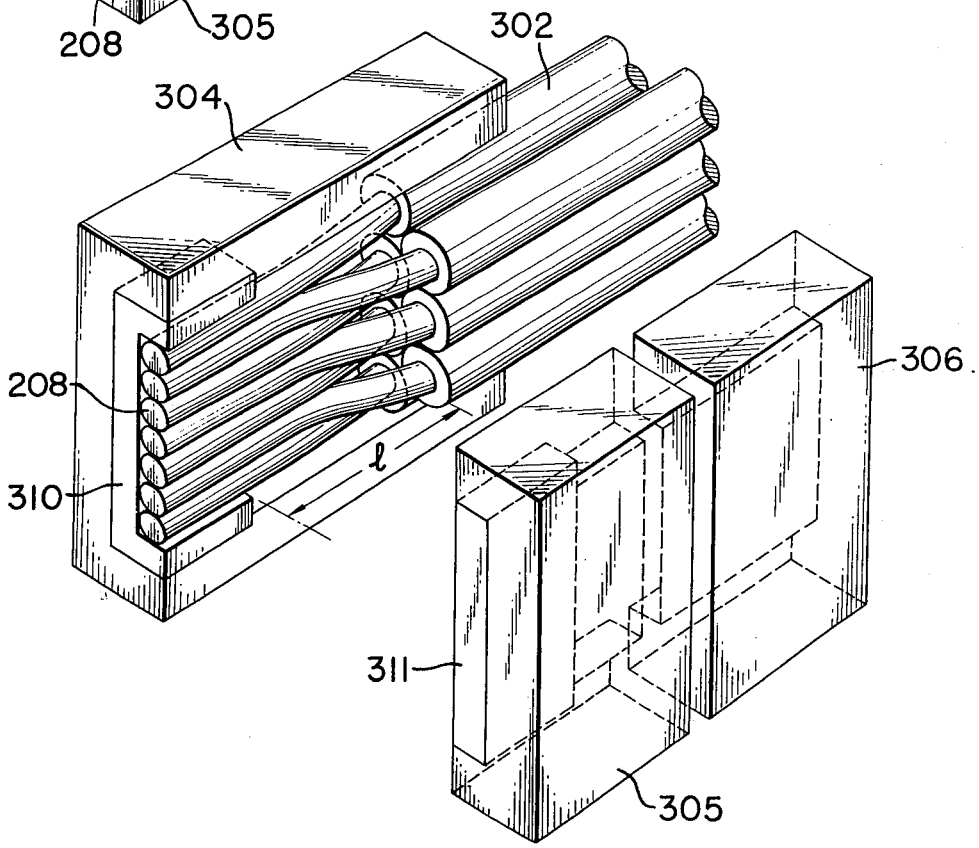
FIG. 24 is an exploded, enlarged, perspective view of the printing wire guide means in the printing head.

Referring to FIGS. 21 to 23, there is shown the appearance of the printing head which comprises a plurality of printing solenoids 313 disposed generally in a fan-like diverging fashion and secured to a holder 301 by means of bosses 303, the holder being attached to the carriage base plate 104. A plurality of printing wires 208 extend from respective ones of the solenoids 313 into printing wire guide plates 304 through flexible guide tubes 302. The rear ends of the guide tubes 302 are secured to the bosses 303 and the fore ends of the tubes are secured between the guide plates 304 and 306 fixed together as by screws or adhesive, as is shown in FIGS. 23 and 24. An opposed guide plate 305 is attached to the forward half of the guide plate 304, and a slot $304_1$, having a width substantially equal to the diameter of each printing wire 208 is formed between the guide plates 304 and 305 and defined by members 310 and 311. The printing wires 208 emerge from the guide tubes 302 and pass through the free space between the guide plates 304 and 305 into the slot $304_1$, where the printing wires are vertically aligned with their printing ends disposed flush with the printing face of the slot. The wires may be extended from and retracted into the slot by an electromagnetic plunger which is provided behind the solenoids 313 and to which the wires are directly connected. Alternatively, the rear ends of the guide tubes 302 may be secured to such plunger and the rear ends of the printing wires may be connected to those rear ends of the guide tubes.

The coil of each electromagnetic solenoid 313 is connected with a printed circuit board 307 (FIG. 22), to which may also be connected a cord passing through a bushing 309. The carriage base plate 104 may be reciprocated by the screw shaft 103 in a plane perpendicular to the web of paper as viewed in FIG. 22, while the printing wires may be extended and retracted with respect to the web of paper which may be intermittently moved perpendicularly to the direction of movement of the carriage by an amount corresponding to each print line, thereby successively providing dots of ink representing desired characters or symbols by means of inking ribbon 270. Reference numeral 312 designates a plate for protecting the printing paper against contamination, and this will further be described.

Figure 26:
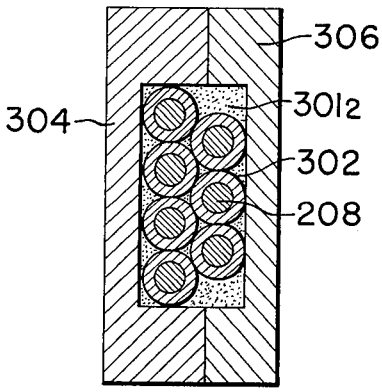
FIG. 26 is a cross-section taken along line XXVI—XXVI in FIG. 23.

In the above-described construction, the printing ends of the printing wires 208 are disposed close together and vertically aligned as seen in FIG. 23, whereas the forward ends of the guide tubes 302 are in vertically zigzagged relationship as seen in FIG. 26. Also, the bosses 303 or the solenoids 313 forming the roots or bases of the tubes are horizontally zigzagged, as seen in FIG. 23. Therefore, the flexible guide tubes 302 with the printing wires 208 therein are flexed between the guide plate 304 and the holder 301, and the difference in flexibility between the wires 208 and the tubes 302 results in the production of friction therebetween.

Figure 27:
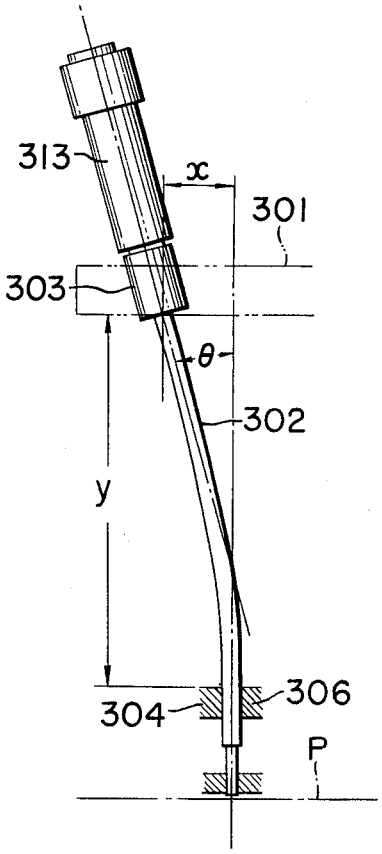
FIG. 27 is a plan view illustrating the relationship among the printing solenoid, the guide tube and the printing wire portion.

Means to avoid this is shown in FIG. 27, wherein the aligned guide tubes are disposed so as to satisfy the relation that $\theta = 3x/2y$, where $y$ is the distance between the point at which the rear end of the guide tube 302 intersects the holder 301 and the point at which the fore end of the guide tube intersects the guide plate 304, the distance being as measured in the direction perpendicular to the web of printing paper P, $x$ is the distance from the point at which said rear end intersects said holder 301 to the plane of the aligned fore ends of the printing wires, and $\theta$ is the angle of flexion of the guide tube 302 with respect to said plane of the aligned wire ends.

This relation has been discovered empirically. When the respective guide tubes 302, bosses 303 and solenoids 313 were secured to the holder 301 in the foregoing angular relationship, the result was that the friction between the guide tubes 302 and the printing wires 208 was negligible.

The bosses or the solenoids 313 may be aligned horizontally or vertically and secured to the holder 301, but in order to minimize the distance $x$, they may preferably be inserted in a common mounting slot $301_1$ at a predetermined angle and fixed by means of screws in the manner as shown in FIG. 23. Alternatively, they may be fixed by filling the clearances therebetween and the clearances between them and the inner wall of the slot $301_1$ with a suitable synthetic resin material $301_2$ such as epoxy-resin or the like and then setting the resin material, in the manner as shown in FIG. 26.

As seen in FIG. 24, the deviation between the plane of the aligned printing end portions of the printing wires 208 and the fore ends of the guide tubes 302 is unavoidable. Therefore, a space of length $l$ is provided therebetween to provide the printing wires with a freedom of flexion to thereby prevent any possible friction between the wires and the open ends of the guide tubes and the guide plates 304, 305.

Figure 28:
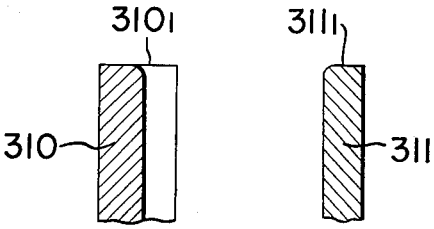
FIG. 28 is a plan view of members forming a wire slot.

A greater value for the length $l$ of the free space would result in a greater degree of flexion of the printing wires 208 which in turn would lead to such disadvantages as reduced impression force of the wires and greater possibility of broken wires. Thus, the length $l$ should desirably be as small as possible. To overcome such a contradiction, arcuate guide surfaces $310_1$ and $311_1$ may be formed on the wire-receiving inlet edges of members 310 and 311 forming the slot $304_1$, in the manner as shown in FIG. 28, to thereby permit smooth entry of the printing wires from the aforesaid free space into the wire-receiving slot.

The members 310 and 311 forming the wire receiving slot may preferably be made of a wear-resistant and relatively friction-free metal, glass, synthetic stone, natural jewel or like material to thereby protect the printing wires 208 against abrasion and provide the durability of the slot.

Figure 25:
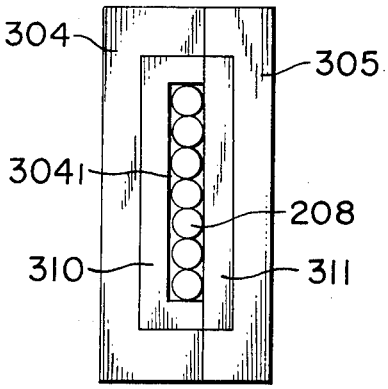
FIG. 25 is an enlarged front view of the printing end face of the printing head.
Figure 29:
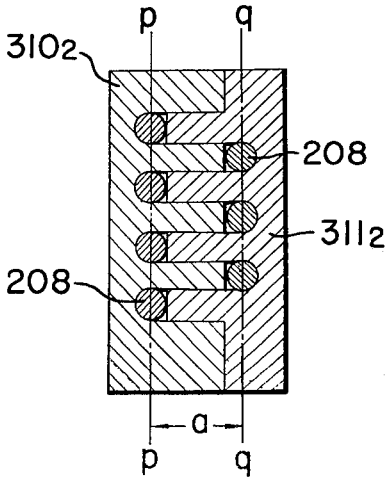
FIG. 29 is a front view showing a modified form of the structure forming the wire slot.

The alignment of the printing wires 208 as shown in FIGS. 23 and 25 is preferable for the purpose of the printing operation control, whereas a plurality of wire receiving slots for the reception of individual wires should preferably be formed for the purpose of preventing the mutual interference between adjacent ones of the wires. In the latter case, the vertical distance between adjacent wires and accordingly, the vertical distance between adjacent ones of the resultant printed dots would be increased. In such case, therefore, the printing wires 208 may be disposed in two columns with a distance $a$ therebetween, as shown in FIG. 29.

Further, where the distance over which a printed dot moves during a print period (corresponding to one of the dots forming a printed pattern) multiplied by an integer is made equal to the distance $a$, the printing wires in the column $p$ may effect printing in accordance with a first signal and the wires in the column $q$ may be operated to print in a signal column in accordance with a signal which is produced when the printing head has been moved over the distance $a$.

In this case, it would be extremely difficult to form wire receiving apertures of a diameter as small as the order of 0.4 mm through the slot forming members 310 and 311 of great hardness. Therefore, as shown in FIG. 29, round-ended concave grooves and convex projections both having a width of 0.5 mm, for example, may be formed in a comb-like fashion in the faces of the members $310_1$ and $311_2$ which are to oppose each other, whereafter the two members may be fitted together at those concave and convex portions with individual wires formed in the round-ended portions of the concave grooves. Thus, wire receiving members of high precision can be produced on a mass-production scale and at a low cost.

Figure 30:
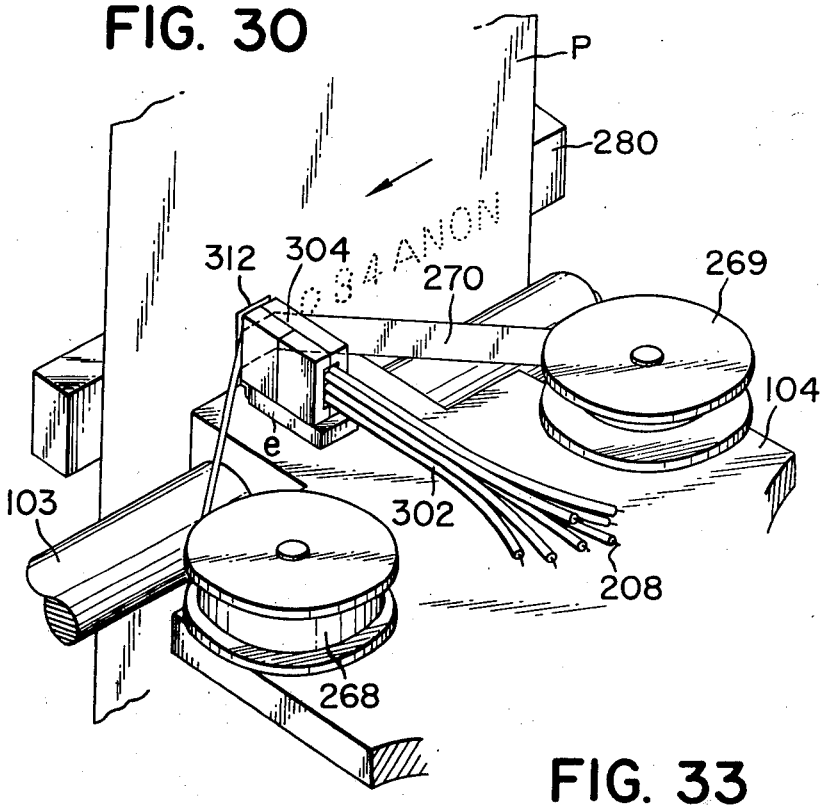
FIG. 30 is a perspective view illustrating means for protecting the printing paper against contamination.
Figure 31:
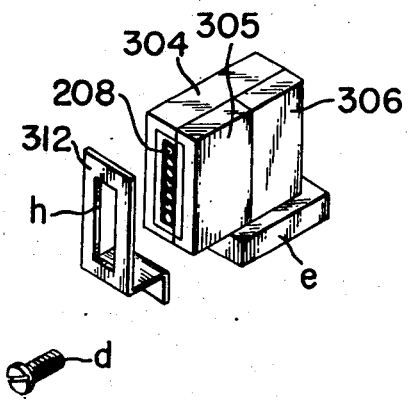
FIG. 31 is an exploded perspective view of the essential parts of the FIG. 30.

Referring to FIG. 30, an anti-contamination plate 312 of small thickness formed with a minimum-dimensioned hole *h* (see FIG. 31) for permitting the printing wires 208 to be extended and retracted therethrough is interposed between the inking ribbon 270 and the web of paper P. A single such hole *h* may be formed to receive therein a group of vertically aligned wires 208 as shown in FIG. 31, or a plurality of discrete holes may be formed to receive individual wires separately. The anti-contamination plate 312 may be secured to a portion *c* of the printing head carriage 104 as by a screw *d* and as close as possible to the inking ribbon 270.

With such construction, only the particular localized parts of the inking ribbon 270 which are pushed forward by the printing wires 208 can contact the paper P but any other areas of the ribbon can not contact the paper, thus protecting the paper against contamination from ink and remarkably enhancing the definition of each dotted character or symbol formed on the paper.

Figure 33:
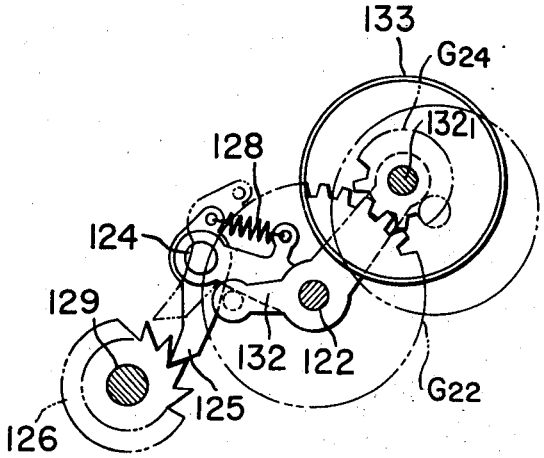
FIG. 33 illustrates the operation of a portion of such mechanism.
Figure 32:
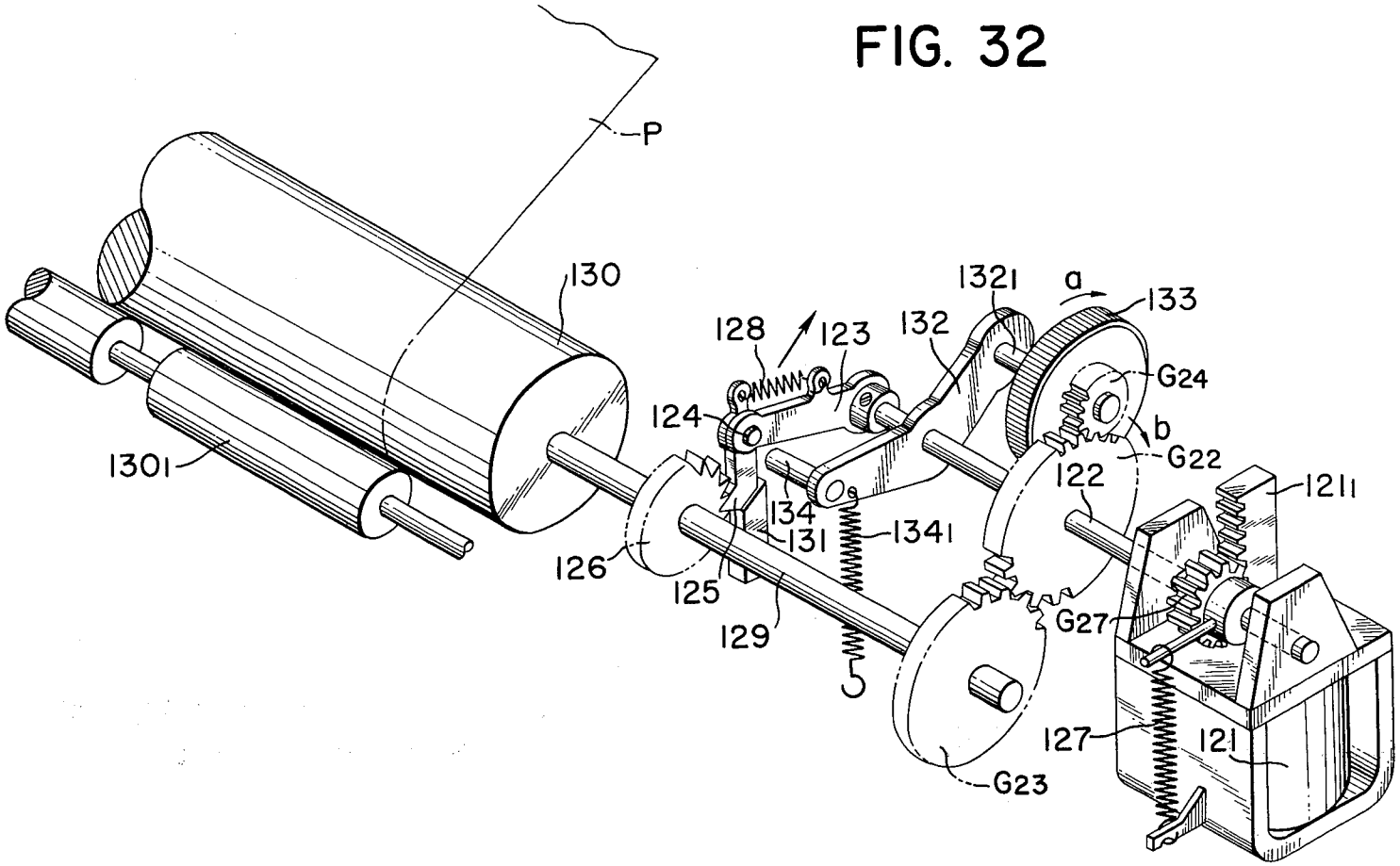
FIG. 32 shows, in perspective view, a manually operated paper feed mechanism.

FIGS. 32 and 33 show a mechanism which may be added to the printer of the present invention for manually feeding a web of paper to the printer. In the shown embodiment, when a current flows to a solenoid 121 in accordance with a paper feed signal, the plunger and integral rack $121_1$ are lowered by a predetermined length of stroke to rotate a gear G27 and accordingly a shaft 122 in clockwise direction, so that a lever 123 secured to the remote end of the shaft is pivoted to raise a ratchet pawl 125 connected thereto by a pin 124. When the current flow to the solenoid 121 is cut off, a return spring 127 acts to return all the foregoing members to their original positions, whereby the ratchet pawl 125 angularly rotates a ratchet wheel 125 through a predetermined angle so that a feed roller 130 integral with the shaft 129 of the ratchet wheel advances the paper P by an amount corresponding to one print line. Numeral 131 designates a stop for the ratchet pawl 125, and numeral 128 a spring for causing the pawl 125 to engage the ratchet wheel 126.

A gear G22 and a ratchet pawl escapement lever 132 are loosely mounted on the shaft 122 of the gear G27. The lever 132 has studded therein a shaft $132_1$, on which is mounted a gear G24 for engagement with the gear G22 and a manually operated feed wheel 133 which is operable externally of the printing machine. A pin 134 is also studded in the lever 132 at the other end thereof, which is normally biased downwardly by a return spring $134_1$. A further gear G23 is in mesh engagement with the gear G22 and securely mounted on the roller shaft 129.

When the manually operated feed wheel 133 is actuated for clockwise rotation as indicated by arrow *a*, the drive is transmitted through the gear G24 to the gear G23 but the feed pawl 125 engaged with the ratchet wheel 126 on the shaft 129 of the gear G23 provides a great resistance to the rotation of the gear G23 and accordingly of the feed roller 130. Therefore, the gear G24 and the feed wheel 133 are displaced along the periphery of the gear G22 in the direction of arrow *b* to assume a position indicated by imaginary lines in FIG. 33, followed by the rotation of the lever 132, so that the pin 134 raises the lever 123 and the feed pawl 125 by a stroke equal to that provided by the solenoid 121 to thereby disengage the feed pawl 125 from the ratchet wheel 126.

Continued actuation of the feed wheel 133 causes this wheel to be rotated about the shaft $132_1$ in the displaced position thereof to drive the gear G23, which in turn rotates the feed roller 130 to feed the paper P freely.

Such paper feed mechanism is applicable for the paper feeding in typewriters and the like as well as in the aforesaid wire matrix printer. When used with typewriters, the mechanism may be modified so that the solenoid 121 for the intermittent feed is replaced by mechanical inter-locking means. Thus, the present mechanism can achieve its intended purpose very simply in that a single operation of the feed wheel 133 results in both the release and advance of the ratchet means.

Figure 34:
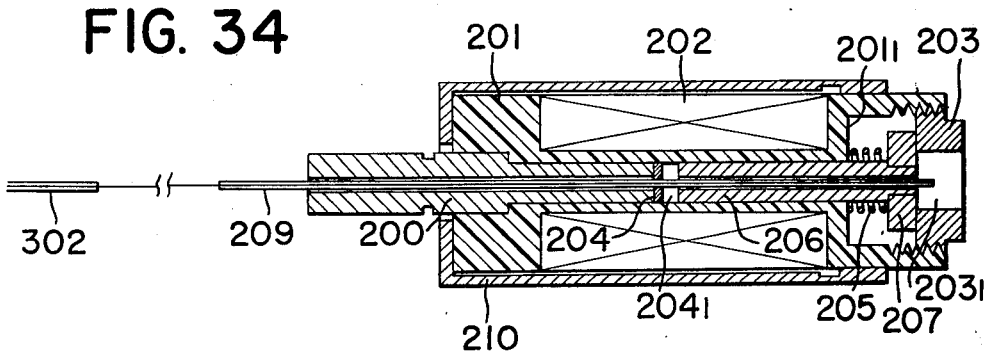
FIG. 34 shows, in cross-section, a form of the printing solenoid.

FIG. 34 illustrates, in cross-section, an embodiment of the printing solenoid for the printing wires forming the wire print head, in which the adjustment of the degree of extension and retraction of the printing wires and the replacement of these wires can be accomplished with great ease. As shown, a stationary tubular iron core 200 is securely mounted within substantially the forward half of a bobbin 201 for a coil 202 to which a signal current is passed, and a movable tubular iron core 206 extends coaxially with the movable core and is inserted in substantially the latter half of the bobbin 201 for smooth axial movement with respect to the bobbin. A stop 207 is provided on the rear end of the movable core 206 and opposed to a set screw 203 threadably fitted into the bobbin 201. A return spring 205 is wound around the movable core 206 between the stop 207 and the stepped portion $201_1$ of the bobbin 201. An elongated tube 209 for protecting the printing wire 208 is inserted through the bore of the movable core 206 and secured to the core 206 as by welding. The printing wire 208 is in turn passed through the tube 209 and the rear end thereof is secured to this tube as by soldering or bonding. A washer 204 of non-magnetic material is attached to the rear end of the stationary core 200 to reduce the time delay in the return of the movable core 206 to the stationary core 200, which delay may result from any residual magnetism after the current to the coil 202 is cut off. Numeral $204_1$ designates a space in which the core 206 is movable, and numeral 210 is a shield casing.

When a signal current according to a pattern flows to the coil 202 in the printing solenoid of the described construction, the movable iron core 206 is attracted to the stationary iron core 200 to advance the protective tube 209 with the printing wire 208, whose printing tip will thus effect printing on the paper with the aid of the inking ribbon (not shown). When the current is cut off, the movable core 206 will be returned by the spring 205 to its retracted position determined by the stop 207.

Thus, the stroke of the printing wire 208 can simply and readily be adjusted by adjusting the set screw 203. Once an optimum is attained, the set screw 203 may be fixed to the bobbin 201 to thereby ensure a predetermined performance to be maintained. A bore $203_1$ may be formed through the set screw 203 to permit the rear end of the protective tube and printing wire 209 and 208 to be projected beyond the rear end face of the stop 207. Thus, the printing wire 208 alone may be removed for replacement, whenever required, by fusing the securing means such as solder or the like, or alternatively the assembly of the movable core 206, protective tube 209 and printing wire 208 may be removed for replacement by threadably removing the set screw 203. This means a great ease and readiness with which the adjustment and replacement is accomplished.

Figure 35:
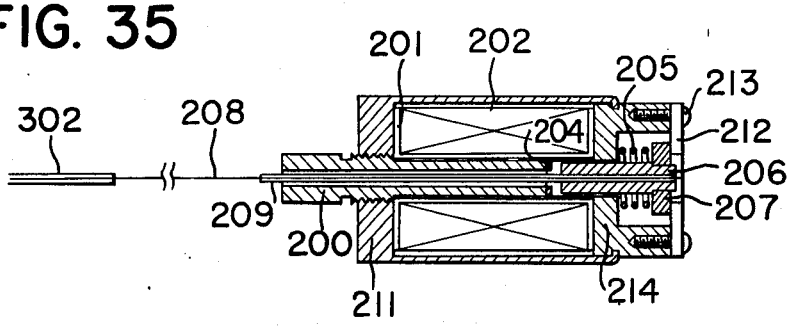
FIG. 35 shows, in cross-section, another form of the solenoid.

FIG. 35 shows another embodiment of the printing solenoid which differs from the embodiment of FIG. 34 in the following points: the shield casing 210 comprises two separate casing members 211 and 214 coupled together as by caulking; these casing members 211 and 214 are formed of a magnetic material to provide a magnetically closed loop which enhances the performance of the solenoid; the set screw 203 is replaced by a cover 212 which may be secured by screws 213 to control the position of the movable iron core 206 under its stationary condition; and the adjustment of the stroke of the movable core 206 may be accomplished with the aid of spiral grooves formed in the stationary core 200 and the casing member 211. After the adjustment of the stroke has been done, the stationary core 200 may be fixed by such means as adhesive or nut. The printing wire may readily be removed for replacement by removing the screws 213.

FIGS. 36 to 41 show a specific example of the electromagnetic clutch 102.

Figure 36:
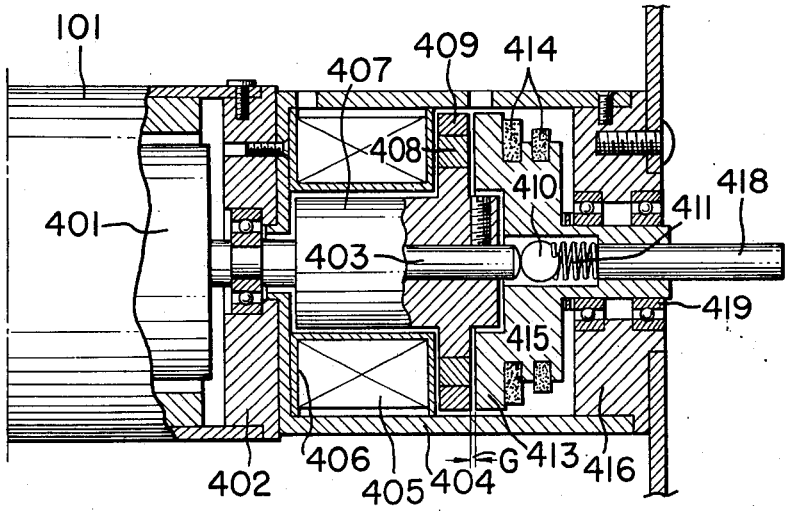
FIG. 36 illustrates, partly in section, a form of the electromagnetic clutch.

Referring to FIG. 36, a driving rotary core 407 is mounted on the shaft 403 of motor 101 and is rotatable by the motor. A coil 405 surrounds the core 407 and is secured to a clutch housing 404 fixed to a motor flange 402 with a bobbin 406 therebetween. A ring member 409 is formed on the driving rotary core 407 perpendicularly to the shaft 403, and a driven rotary core 413 is disposed in face-to-face relationship with the ring member 409. A driven shaft 418 extends coaxially with the shaft 403 and is connected to the core 413 with a return spring 411 and a ball 410 is interposed between the shaft 418 and the motor shaft 403.

There are further seen a housing flange 416, a bearing 419 for the driven rotary core 413 (or driven shaft 418), a spacer 415 for maintaining a predetermined air gap G between the two cores 409 and 413, a motor rotor 401, a ring 408 of non-magnetic material having a great magnetic resistance provided on the core ring member 409 to increase the attraction of the driving rotary cores 407 and 409 with respect to the driven rotary core 413, and a ring of felt 414 attached to the driven rotary core 413 to prevent any oil from leaking from the bearing 419 into the clearance between the cores 413 and 408, 409.

The driving rotary cores 407, 408 and 409 are rotatable together with the motor 101. When a current flows to the coil 405 in response to a clutch input signal, the magnetic line of force resulting therefrom will pass through the cores 407, 413, 409 and housing 404 to form a closed magnetic circuit so that the driven rotary core 413 will be attracted by the driving rotary cores 407–409 and rotated therewith to transmit the drive to the shaft 418. When the current supply to the coil 405 is cut off, the spring 411 will return the transmitting rotary core 413 to its original position to maintain a predetermined air gap G.

Figure 37:
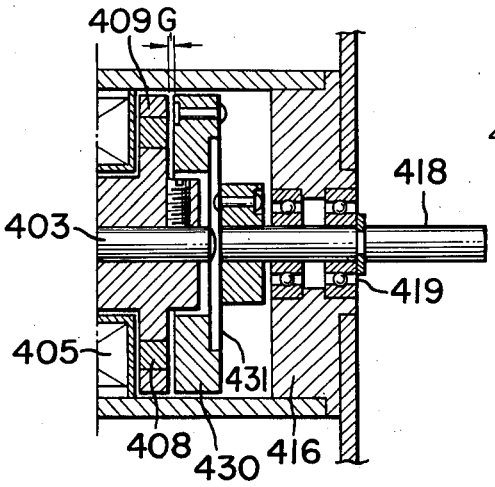
FIG. 37 shows, in section, a conventional clutch.

As shown in FIG. 37, the prior art has generally employed a plate spring 431 to directly connect the driven rotary core 430 and the driven shaft 418 and to return the core 430, but it is difficult in terms of machining technique to increase the accuracy of perpendicularity of the air gap G with respect to the shaft 418. Since some extent of vibration of the driven rotary core 430 is inevitable, a smaller air gap would cause noises to be produced by the touch between the cores. The machining work may be easier and the said demerit in performance eliminated by using a greater thickness for the plate spring 431, but this would apparently encounter a greater consumption of the power applied to the coil 405 and a greater size of the clutch itself. All these disadvantages may be overcome by the embodiment shown in FIG. 36 wherein the driven rotary core 413 (or shaft 418) is supported for slight thrust movement within the clutch housing and directly connected to the driven shaft 418 with the spring 411 interposed between the driven shaft 418 and the motor shaft 403.

Figure 38:
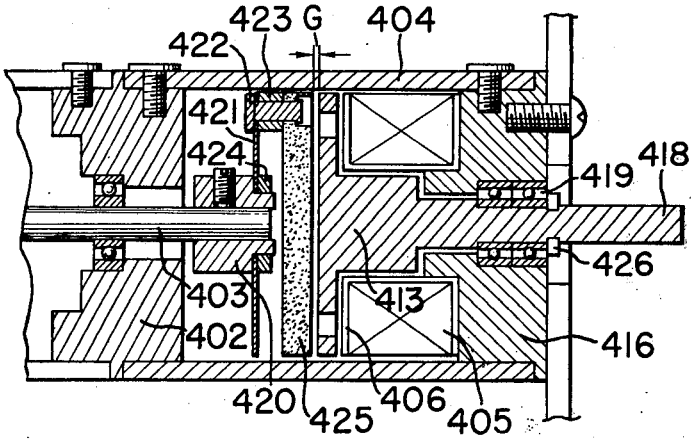
FIG. 38 is a cross-sectional view showing another form of the electromagnetic clutch according to the present invention.
Figure 39:
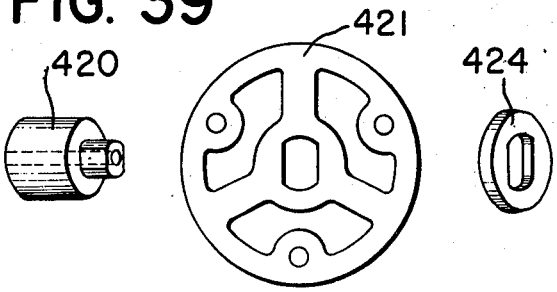
FIG. 39 is an exploded view of the driving rotary core in the clutch of FIG. 38.

FIG. 38 shows another embodiment of the electromagnetic clutch 102 in which a disc spring 421 is secured to a boss 420 secured to a motor shaft 403 by means of screws. The disc spring 421 has a driving rotary core 425 attached thereto by means of pin 422. As shown in FIG. 39, a keep plate 424 is used to secure the circular disc 421 to the boss 420 by inserting the coin-shaped center opening of the disc spring 421 over the complementary shaft portion of the boss 420 and caulking them together by means of the keep plate 424. The coin-shaped opening in the spring 421 is also useful to prevent any loosening from occurring in the direction of rotation during power transmission. A bearing assembly 419 is forced into the housing 416 and a bobbin 406 having a coil 405 therein is secured by bonding. A driven rotary core 413 is inserted into the bearing 419 and secured by means of clamp washer 426 to reduce the play resulting from thrust.

Figure 40:
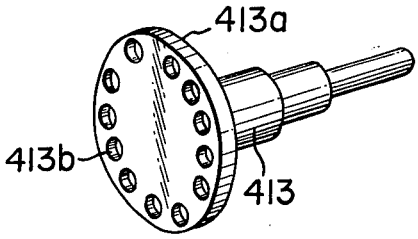
FIG. 40 is a perspective view of the driven rotary core in the same clutch.
Figure 41:
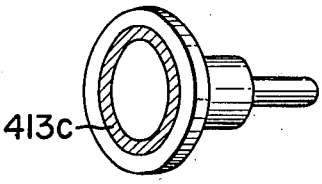
FIG. 41 shows, in perspective view, a conventional form of such driven core.

As shown in FIG. 40, the driven rotary core 413 has a number of apertures **413*b* formed circumferentially of the disc member 413*a* thereof. By making these apertures 413*b* play the role as a non-magnetic member, the procedures such as bonding, surface machining, etc. may be eliminated to enhance the ease of mass production. Thus, the embodiment of FIG. 40 eliminates all the additional procedures required in the conventional structure of FIG. 41 wherein a ring 413*c*** of non-magnetic material has specially been attached to the front disc face as by bonding, whereafter the front face of the ring had to be subjected to surface machining for a good surface flatness.

We claim:

1. A printing device comprising a pair of spools mounted on a carriage for supplying and winding up a ribbon for printing, said spools each having a shaft;

a motor; and means mounted on said carriage for transmitting the rotational force of said motor to one of said spools, said transmitting means including, a first gear driven by means adjacent said carriage engaging said first gear, a plurality of gears rotatably in mesh with said first gear, a turret head disposed coaxially with said first gear for rotatable movement and having thereon said plurality of gears, an index gear coaxially and integrally provided with said turret head, a ball fitted in a valley portion of said index gear, a spring for pressing said ball, a screw for fixing and adjusting the urging force of said spring, intermediate gears mounted on said carriage for selective engagement with one of said plurality of gears, and spool gears provided on the shafts of said pair of spools, respectively, to be in mesh with said intermediate gears, and wherein said intermediate gears transmit the motor rotational force to one of said spool gears upon being selectively rotated by one of said plurality of gears and said plurality of gears, turret head, index gear, ball, spring and screw are employed to automatically switch the ribbon feeding when the ribbon has been exhausted from one of said pair of spools.

2. A printing device according to claim 1, wherein said screw is provided with a rotating amount adjusting portion and said adjusting portion is manually operable to set the urging force of said spring to adjust the timing of switching of the ribbon winding operation by said pair of spools.

3. A printing device according to claim 1, wherein said gears are provided with pointed teeth.

4. A printing device according to claim 1, wherein said intermediate gears are rotatably mounted on a movable plate to ensure mesh engagement with said plurality of gears.

5. A wire printer head comprising:

a plurality of printing wires;

a plurality of guide tubes each covering said printing wires;

a first holding member of U-shape for holding said plurality of printing wires in a line against resilient forces thereof acting in longitudinal and lateral directions;

a second holding member disposed in facing relationship with said first member to retain said printing wires in a line between said first and second holding members;

a first single cover member of U-shape for covering said first holding member and for covering said plurality of guide tubes; and a second cover member for covering said second holding member, said second cover member being disposed in facing relationship with said first cover member to hold said holding members in facing disposition and said printing wires in a line.

6. A wire printer head according to claim 5, wherein said first and second holding members form a wire receiving opening when disposed in said facing relationship, the peripheral edge of said opening adjacent said guide tubes being rounded to allow smooth movement of the printing wire relatively thereto.

* * * * *